United States Patent [19]

Williams

[11] Patent Number: 4,632,496

[45] Date of Patent: Dec. 30, 1986

[54] CONNECTOR SOCKET

[76] Inventor: Robert A. Williams, 2721 White Settlement Rd., Fort Worth, Tex. 76107

[21] Appl. No.: 786,143

[22] Filed: Oct. 8, 1985

Related U.S. Application Data

[63] Continuation of Ser. No. 535,838, Sep. 26, 1983, abandoned.

[51] Int. Cl.[4] ..... H01R 13/11
[52] U.S. Cl. ..... 339/256 S
[58] Field of Search ..... 339/256 S

[56] References Cited

U.S. PATENT DOCUMENTS

| | | | |
|---|---|---|---|
| 1,657,253 | 1/1928 | Fortin | 339/256 S |
| 2,124,461 | 7/1938 | Challet | 339/256 S |
| 2,982,935 | 5/1961 | Barnard | 339/256 S |
| 3,205,468 | 9/1965 | Henschen | 339/256 S |

FOREIGN PATENT DOCUMENTS

| | | | |
|---|---|---|---|
| 227696 | 10/1959 | Australia | 339/256 S |
| 681501 | 3/1964 | Canada | 339/256 S |

*Primary Examiner*—Joseph H. McGlynn
*Attorney, Agent, or Firm*—Arthur F. Zobal

[57] ABSTRACT

A socket member has an opening formed therein. A coil spring having offset coils or coils with offset coil portions is located in the opening to electrically receive an electrical pin from one end or to electrically receive electrical pins from opposite ends.

5 Claims, 12 Drawing Figures

CONNECTOR SOCKET

This is a continuation of co-pending application Ser. No. 535,838 filed Sept. 26, 1983, now abandoned.

BACKGROUND OF THE INVENTION

1. Description of the Prior Art

The prior art electrical connectors of the socket and pin type have disadvantages at high temperatures in that the socket will open, disengaging the pin.

2. Summary of the Invention

It is an object of the present invention to provide a very reliable connector socket that will maintain its position at high temperatures.

It is a further object of the present invention to provide a connector socket that can accept different sizes of pins.

The connector socket comprises a socket means having an opening formed therein from a first end. A metallic coil spring is located in said opening of said socket means. Said coil spring has a central opening formed by the inside structure of its coils for receiving an electrical pin means by way of said first end of said opening of said socket means. A plurality of said coils of said coil spring each has portions at different angular positions around the central axis of said central opening which are at different distances from said central axis of said central opening. A plurality of said coils of said coil spring have inside coil portions offset from inside coil portions of adjacent coils relative to said central axis such that said central opening has offset portions along its length whereby portions of the inside structure of said coil spring will engage said pin means when it is located in said central opening of said coil spring.

In another aspect, said opening of said socket means extends through said socket means and said central opening of said coil spring extends through said coil spring for receiving electrical pin means at each end of said coil spring.

In one embodiment, a plurality of first coils of said coil spring are offset from a plurality of second coils of said coil spring transversely to said axis of said central opening of said coil spring.

In another embodiment, each coil of a plurality of said coils of said coil spring has at least one generally straight portion. Said generally straight portions of said plurality of said coils of said coil spring are located at different angular positions around said axis of said central opening.

DESCRIPTION OF THE PREFERRED EMBODIMENTS

Figure 1:
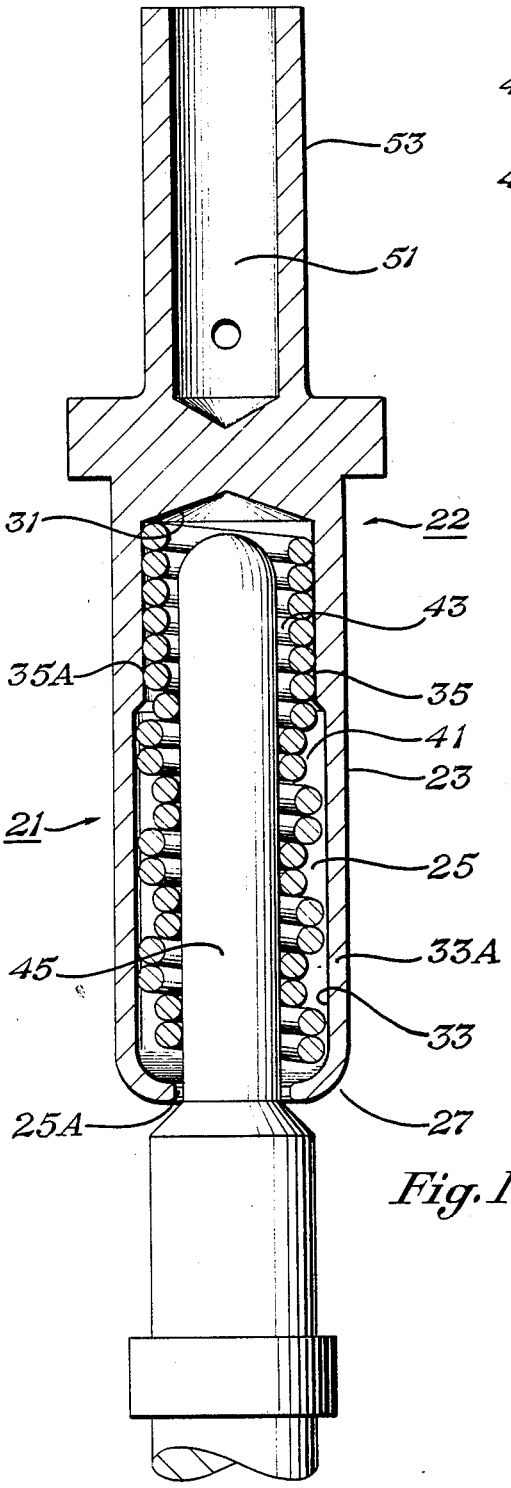
FIG. 1 is a cross-sectional view of a connector socket of one embodiment of the present invention.

Referring now to FIG. 1 of the drawings, the connector socket is identified at 21. It comprises a metallic body 22 having a socket member 23. The socket member 23 has an elongated opening 25 formed therein from an end 27 which is open at 25A. The opening 25 extends to a closed wall 31. The opening 25 comprises two portions 33 and 35 of different diameters with the portion 35 of larger diameter being located next to the end 27 and the portion 35 of smaller diameter being spaced away from the end 27.

Located in the opening 25 is an elongated metallic coil spring 41 having a central opening 43 formed therethrough for receiving a cylindrical shaped metallic pin 45 which is connected to an electrical lead. First pairs of coils 41A are alternately offset from second pairs of coils 41B transversely to the axis 43A of the central opening 43 such that inside portions 41A1 of coils 41A are closer to the axis 43A than inside portions 41A2 and inside portions 41B1 of coils 41B are closer to the axis 43A than inside portions 41B2. The coil 41 may be helically wound with its coils in alignment and then mechanically deformed to form the alternate offset pairs of coils 41A and 41B.

Initially the end 27 of the socket member 23 is not rounded inward but is straight with the wall 33A such that the entrance 25A is the same size as the portion 33 of the opening 25. The coil spring 41 is inserted into the opening 25 by way of the initially larger entrance 25A and press fitted into the portion 35 of the opening 25 such that the coils 41A and 41B tightly engage the inside wall 35A of the opening portion 35. The inside wall 35A aligns the coils 41A and 41B in the open portion 35. The pressure exerted by the coils 41A and 41B on the wall 35A securely holds the coil spring and forms a good electrical connection between the coil spring and the socket member at a plurality of points.

The inside diameter of each of the coils 41A and 41B of the coil spring 41 is greater than the outside diameter of the pin 45 such that if the pin 45 is located concentrically within each coil as shown in the portion 35 of the opening 25, the pin 45 will not engage the coil. In the portion 33 of the opening 25, however, the coils 41A and 41B retain their offset configuration and when the pin 45 is inserted into the central opening 43 of the coil spring 41, it will engage alternate sides of the alternate pairs of coils 41A and 41B as shown in FIG. 1. Thus, a good electrical connection is made between the pin 45 and the coils of the coil spring 41 in the portion 33 of the opening 25.

An increase in temperature will not affect the electrical connection between the pin 45 and the coil spring 41 and between the coil spring 41 and the socket member 23. Moreover, the electrical connection between the pin 45 and the coil spring 41 and between the coil spring 41 and the socket member 23 occurs at a plurality of points. Thus a high reliability, high temperature connector socket is provided. Pins of different sizes may be inserted into the coil spring 41. A pin 45 of larger diameter than that shown in FIG. 1 will move the coil pairs 41A and 41B in the portion 33 of the opening 25 more into alignment and more tightly engage the coils of the coil spring.

In one embodiment, the body 22 and the coil spring 41 each may be formed of Be-Cu. After the coil spring 41 is inserted into the opening 25, the end 27 is rolled over to form the open entrance 25A of reduced diameter. The other end of the body 22 has an opening 51 formed therein for receiving an electrical lead which is secured in place by crimping the wall 53. The pin 45 is connected to an electrical lead. Other means, not shown, is provided for holding the body 22 and the pin 45 together after the pin 45 has been inserted into the central opening 43 of the coil 41 located in the opening 25.

For a pin 45 having an outside diameter of 0.060 of an inch, the inside diameter of the coils of the coil spring 41 may be 0.063–0.065 of an inch. The wire diameter of the coil spring is 0.020 of an inch. Portions 33 and 35 of opening 25 both are circular in cross-section. The inside diameter of the portion 35 of the opening 25 is only slightly greater than the outside diameter of the coils of the coil spring such that the coils will tightly engage the inside wall 35A of the opening portion 35 when the coils are located therein. The portion 33 of the opening 25 may have an inside diameter of 0.112–0.114 of an inch which is about equal to the maximum outside spring dimension D after the spring 41 has been deformed.

Figure 3:
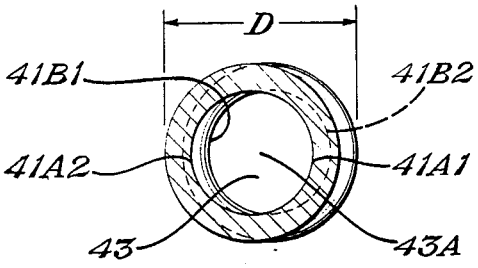
FIG. 3 is a cross-sectional view of FIG. 2, taken along the lines 3—3 thereof.
Figure 2:
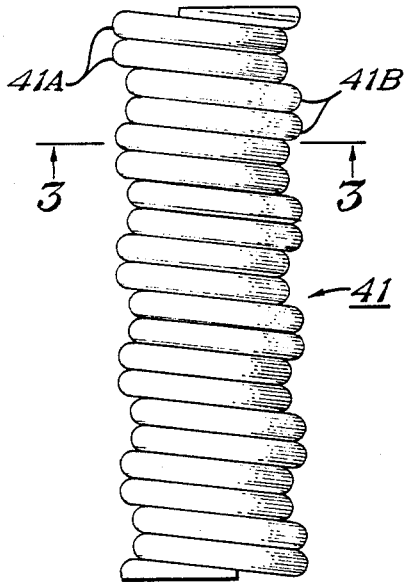
FIG. 2 illustrates the coil spring of FIG. 1 prior to insertion of the coil spring in the socket of FIG. 1.
Figure 4:
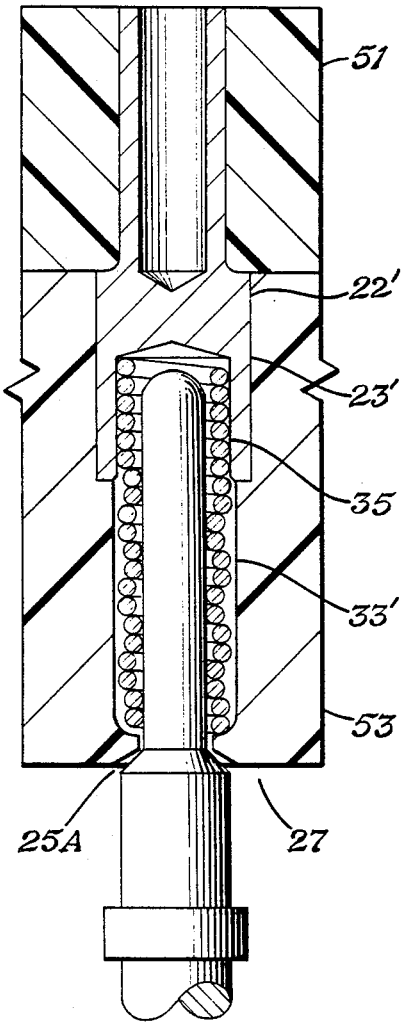
FIG. 4 is a cross-sectional view of another embodiment of the connector socket of the present invention.

Referring now to FIG. 4, the connector socket shown therein is similar to that of FIG. 1 except that the metallic body member 22' is embedded in plastic members 51 and 53 and the socket member 23' is shortened with the portion 33' of the opening 25 being formed in the plastic member 53. The coil spring 41 is the same as that shown in FIGS. 1–3.

Figure 5:
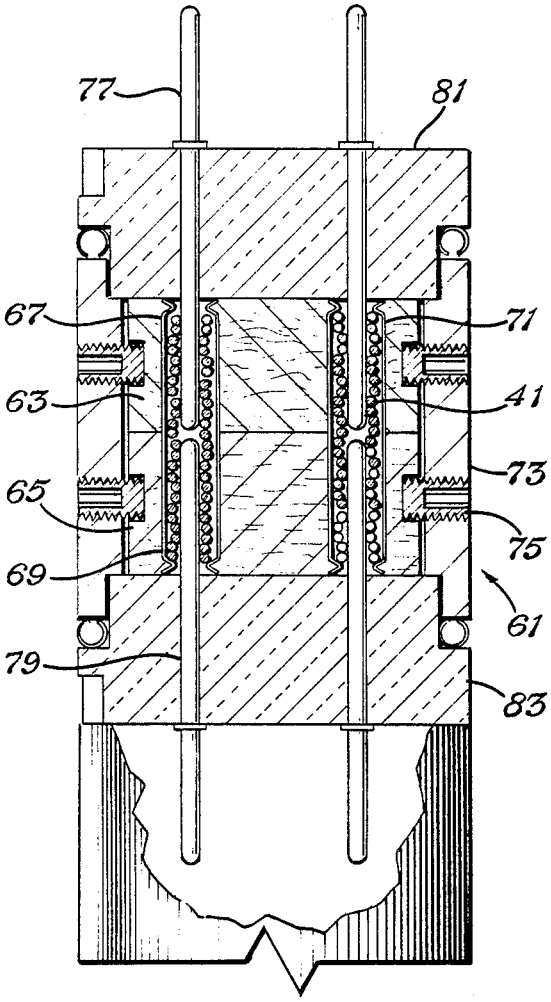
FIG. 5 is a cross-sectional view of still another embodiment of the connector socket of the present invention.

Referring to FIG. 5, the connector socket shown is identified at 61. It comprises two cylindrical shaped members 63 and 65 formed of electrical insulating material. Members 63 and 65 have a plurality of aligned apertures 67 and 69 formed therethrough in which are located metal tubular members 71. The coils 41 are located in tubular member 71. Cylindrical members 63 and 65 are held together by a surrounding sleeve 73 and set screws 75. Metal pins 77 and 79 carried by cylindrical ceramic members 81 and 83 can be inserted into the opposite ends of the coils 41 of the member 61 to electrically couple pins 77 to pins 79. If desired, the socket members 21 of FIG. 1 may be connected to the other ends of the pins 77 and 79 to provide electrical connection to other circuitry.

Figure 6:
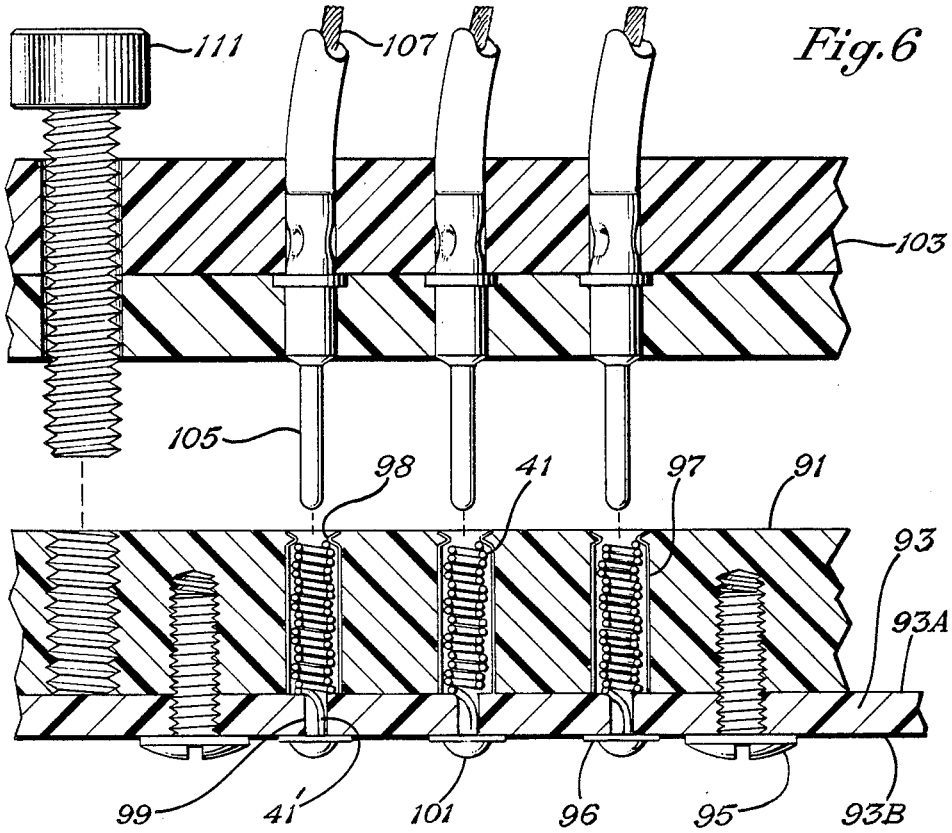
FIG. 6 is a cross-sectional view of connector sockets of the present invention employed for connecting electrical leads to a printed circuit.
Figure 11:
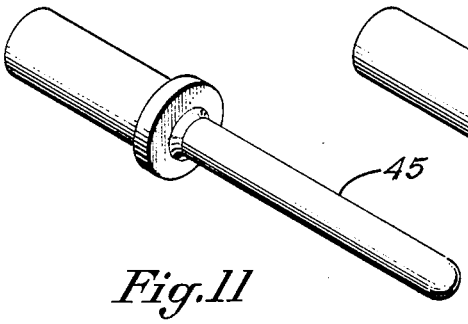
FIGS. 11 and 12 illustrate different types of electrical pins that may be inserted into the coil springs of the connector sockets of the present invention.

Referring to FIG. 6, the connector socket comprises an electrical insulating member 91 secured to one side 93A of a printed circuit board 93 by bolts 95. The desired printed circuit 96 is formed on side 93B of board 93. Apertures 97 are formed through member 91 and tubular metal members 98 are located in the apertures 97. The coils 41 are located in tubular members 98. The ends 41' of the coils 41 next to the board 43 extend through aligned apertures 99 formed through the board 93 and are soldered at 101 to the printed circuit 96. A plate 103 formed of electrical insulating material carries electrical pins 105 connected to electrical leads 107. The pins 103 may be inserted into the coils 41 carried by member 91 to electrically couple the leads 107 to the printed circuit 96. Bolts 111 are employed to secure the plate 103 to the member 91.

Figure 7:
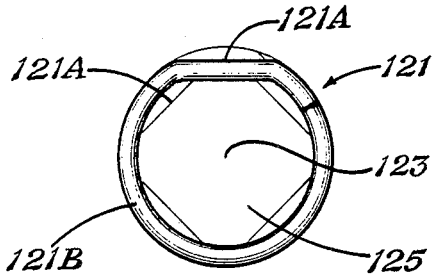
FIGS. 7 and 8 are end views of different embodiments of the coil spring of the present invention.
Figure 9:
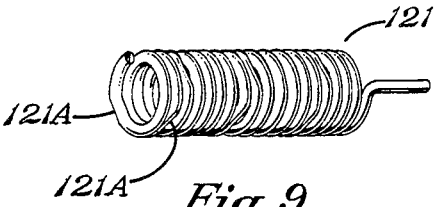
FIG. 9 is a perspective view of a coil spring of FIG. 7 wound with a single wire.

Referring to FIGS. 7 and 9, each of the coils of the coil spring 121 has a straight portion 121A and a curved portion 121B with the straight portions 121A of a plurality of the coils located at different angular positions around the axis 123 of the central opening 125 formed through the coil spring 121. The coil spring 121 may be formed by helically winding a metal wire around a round rod which has a straight flat portion on one side along its length. The wire will conform to the shape of the rod as it is wound under tension. When the tension is released and the wire is relaxed, the straight portions 121A of the wire coils formed from the straight flat portion of the rod will be located at different angular positions around the axis 123. The straight portions of 121A of the coils of the resulting coil spring will securely engage an electrical pin of the appropriate cross-sectional size when it is located within the central opening 125 to provide the desired electrical connection. The spring 121 can receive and electrically engage electrical pins of different cross-sectional sizes within a given range.

Figure 8:
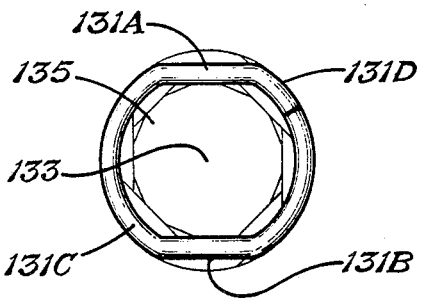
Figure 10:
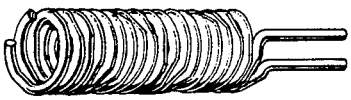
FIG. 10 is a perspective view of a coil spring of the present invention wound with two wires.

The coil spring 131 of FIG. 8 is similar to the coil spring 121 of FIG. 7 except that each coil has two straight portions 131A and 131B located between two curved portions 131C and 131D. The straight portions 131A and 131B of a plurality of the coils are located at different angular positions around the central axis 133 of its central opening 135. The coil spring 131 may be formed by helically winding a metal wire around a round rod which has two straight flat portions on opposite sides along its length. The wire will conform to the shape of the rod as it is wound under tension. When the tension is released and the wire is relaxed, the straight portions 131A and 131B of the wire coils formed from the two straight flat portions of the rod will be located at different angular positions around the axis 133. This is illustrated in FIG. 10. The coil of FIG. 10 is formed from two wires wound helically around the rod when it is formed. It is to be understood that two wires or more could be wound to form the coil of FIGS. 7 and 9. The straight portion 131A and 131B of each of the coils of the coil spring 131 will securely engage an electrical pin of the appropriate cross-sectional size when it is located within the central opening 135 to provide the desired electrical connection. The coil spring 131 can receive and electrically engage electrical pins of different cross-sectional sizes within a given range. The coils of FIGS. 7–9 may be located within the tubular members 71 of the connector socket 61 of FIG. 5 or within the tubular members 95 of the socket member of FIG. 6 to provide good electrical connection with the electrical pins to be inserted within their central apertures.

Figure 12:
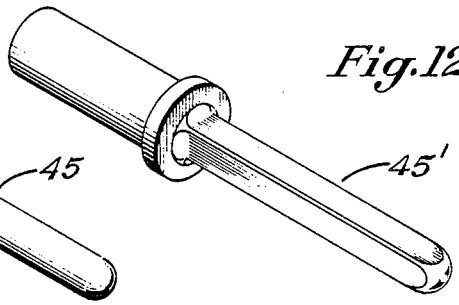

Electrical pins of the type shown at 45' in FIG. 12 may be effectively used in the connector sockets of the present invention.

It is to be understood that the metal tubular members 71 and 98 of the embodiments of FIGS. 5 and 6 may be eliminated if desired.

What is claimed is:

1. An electrical connector comprising:

a socket means having an opening formed therein from a first end, said opening of said socket means comprises first and second portions located along its length, the wall of at least said second portion of said opening of said socket means being formed of electrical conducting material, said first portion of said opening of said socket means having a cross-sectional area greater than that of said second portion of said opening of said socket means, said second portion of said opening of said socket means being cylindrical in cross-section, said first portion of said opening of said socket means being located next to said first end of said socket means and said portion of said opening of said socket means being spaced away from said first end of said socket means, a metallic coil spring located in said first and second portions of said opening of said socket means and engaging said wall of said second portion of said socket means, said coil spring having a central opening formed by the inside structure of its coils for receiving an electrical pin means by way of said first end of said opening of said socket means, a plurality of said coils of said coil spring each having portions at different angular positions around the central axis of said central opening which are at different distances from said central axis of said central opening, a plurality of said coils of said coil spring having inside coil portions offset from inside coil portions of adjacent coils relative to said central axis such that said central opening has offset portions along its length, when said coil spring is located in said first and second portions of said opening of said socket means, said coils of said coil spring in said second portion of said opening of said socket means are held in alignment by said wall of said second portion of said opening of said socket means, the inside diameter of each of said coils of said coil spring being greater than the outside diameter of said electrical pin means such that said electrical pin means will not engage the coils of said coil spring in said second portion of said opening of said socket means, but said inside offset coil portions of said coil spring in said first portion of said opening of said socket means will engage said pin means in said first portion of said opening of said socket means when said pin means is located in said central opening of said coil spring.

2. An electrical connector comprising:

a socket means having an opening formed therein from a first end, said opening of said socket means comprises first and second portions located along its length, the wall of at least said second portion of said opening of said socket means being formed of electrical conducting material, said first portion of said opening of said socket means having a cross-sectional area greater than that of said second portion of said opening of said socket means, said first portion of said opening of said socket means being located next to said first end of said socket means and said second portion of said opening of said socket means being spaced away from said first end of said socket means, a metallic coil spring located in said first and second portions of said opening of said socket means and engaging said wall of said second portion of said socket means, said coil spring having a central opening formed by the inside structure of its coils for receiving an electrical pin means by way of said first end of said opening of said socket means, a plurality of said coils of said coil spring each having portions at different angular positions around the central axis of said central opening which are at different distances from said central axis of said central opening, a plurality of first coils of said coil spring being offset from a plurality of second coils of said coil spring transversely to said axis of said central opening of said coil spring such that said central opening has offset portions along its length whereby portions of the inside structure of said coil spring will engage said pin means when it is located in said central opening of said coil spring, when said coil spring is located in said first and second portions of said opening of said socket means, said first and second coils of said coil spring in said second portion of said opening of said socket means are held in alignment by said wall of said second portion of said opening of said socket means, the inside diameter of each of said coils of said coil spring being greater than the outside diameter of said electrical pin means such that said electrical pin means will not engage the coils of said coil spring in said second portion of said opening of said socket means when said pin means is located in said central opening of said coil spring.

3. The electrical connector of claim 2, wherein:

the size of said first portion of said opening of said socket means is sufficient to allow said coils of said coil spring to be moved transversely relative to each other by said pin means as it is inserted into said central opening of said coil spring.

4. An electrical connector comprising:

a socket means having an opening formed therein from a first end, said opening of said socket means comprises first and second portions located along its length, the wall of at least said second portion of said opening of said socket means being formed of electrical conducting material, said first portion of said opening of said socket means having a cross-sectional area greater than that of said second portion of said opening of said socket means, said first portion of said opening of said socket means being located next to said first end of said socket means and said second portion of said opening of said socket means being spaced away from said first end of said socket means, a metallic coil spring located in said first and second portions of said opening of said socket means and engaging said wall of said second portion of said socket means, said coil spring having a central opening formed by the inside structure of its coils for receiving an electrical pin means by way of said first end of said opening of said socket means, said coil spring having offset portions along its length relative to the axis of its central opening, when said coil spring is located in said first and second portions of said opening of said socket means, said coils of said coil spring in said second portion of said opening of said socket means are held by said wall of said second portion of said opening of said socket means in positions such that said electrical pin means will not engage the coils of said coil spring in said second portion of said opening of said socket means, but said offset portions of said coil spring in said first portion of said opening of said socket means will engage said pin means in said first portion of said opening of said socket means when said pin means is located in said central opening of said coil spring.

5. The electrical connector of claim 4 wherein:

the inside diameter of each of said coils of said coil spring being greater than the outside diameter of said electrical pin means.

* * * * *